US007445477B2

(12) United States Patent
Ting et al.

(10) Patent No.: US 7,445,477 B2
(45) Date of Patent: Nov. 4, 2008

(54) CARD CONNECTOR WITH EJECTOR

(75) Inventors: Chien-Jen Ting, Tu-Cheng (TW); Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/708,722

(22) Filed: Feb. 20, 2007

(65) Prior Publication Data

US 2007/0218727 A1 Sep. 20, 2007

(30) Foreign Application Priority Data

Mar. 20, 2006 (TW) ..... 95109392 A

(51) Int. Cl.
*H01R 13/62* (2006.01)

(52) U.S. Cl. ..... 439/159

(58) Field of Classification Search ..... 439/159, 439/160, 155

See application file for complete search history.

(56) References Cited

U.S. PATENT DOCUMENTS

| | | | | |
|---|---|---|---|---|
| 5,533,906 | A * | 7/1996 | Abe | 439/159 |
| 5,655,918 | A * | 8/1997 | Soh | 439/159 |
| 6,030,238 | A * | 2/2000 | Dong | 439/159 |
| 6,988,904 | B1 * | 1/2006 | Lai | 439/159 |
| 2005/0277333 | A1 | 12/2005 | Kuo | |

* cited by examiner

*Primary Examiner*—Javaid Nasri
(74) *Attorney, Agent, or Firm*—Wei Te Chung

(57) ABSTRACT

A card connector comprises an insulating housing defining a card insertion/ejection direction; a plurality of contacts received in the insulating housing; a shell covering the insulating housing and an ejector. The ejector is assembled to the shell and comprises a push member, a moveable member mating with the push member, an ejecting member to eject a card and a pivoting member mating with the moveable member and the ejecting member. The ejecting member is moveable along a direction parallel to the card ejection direction to eject the card.

18 Claims, 12 Drawing Sheets

CARD CONNECTOR WITH EJECTOR

BACKGROUND OF THE INVENTION

1. Field of the Invention

The present invention is generally related to a card connector, and more particularly, to a card connector which has an ejector.

2. Description of Related Art

With the development of electronic appliances, different electrical cards are used to expand additional functions of the electronic appliance, such as data storage. A card connector is required to receive the electrical card to achieve the storage or transmission of signal between the electrical card and the corresponding electronic appliance. For adapting to requirements to a card, an express card, which has quicker speed than a conventional card at data transmission are achieved. The express card has two types in configuration, one is rectangular and another is L-shaped.

US Application Publication No. 20050277333 discloses an express card connector, which comprises an insulating housing, a plurality of contacts received in the insulating housing, a shell covering the insulating housing and an ejector assembled to a right side of the shell. The ejector comprises a slider, a push rod, a spring, a link pin and an ejecting rod. Apparently, when ejecting an express card, an ejecting force mainly focuses on a front end of the express card adjacent to the push rod. In this situation, the ejecting force urging on the card is not balance. Especially, when the express card is L-shaped, the problem is even obvious that the L-shaped express card will deflect when ejected and not be ejected conveniently because the ejecting force is not balance.

Hence, an improved card connector is required to overcome the disadvantages of the related art.

SUMMARY OF THE INVENTION

Accordingly, an object of the present invention is to provided a card connector which can eject a card conveniently.

To achieve the above objects, a card connector comprises an insulating housing defining a card insertion/ejection direction; a plurality of contacts received in the insulating housing; a shell covering the insulating housing and an ejector. The ejector is assembled to the shell and comprises a push member, a moveable member mating with the push member, an ejecting member to eject a card and a pivoting member mating with the moveable member and the ejecting member. The ejecting member moves along a direction parallel to the card ejection direction to eject the card.

Other objects, advantages and novel features of the present invention will be drawn from the following detailed description of a preferred embodiment of the present invention with attached drawings.

DETAILED DESCRIPTION OF THE INVENTION

Figure 1:
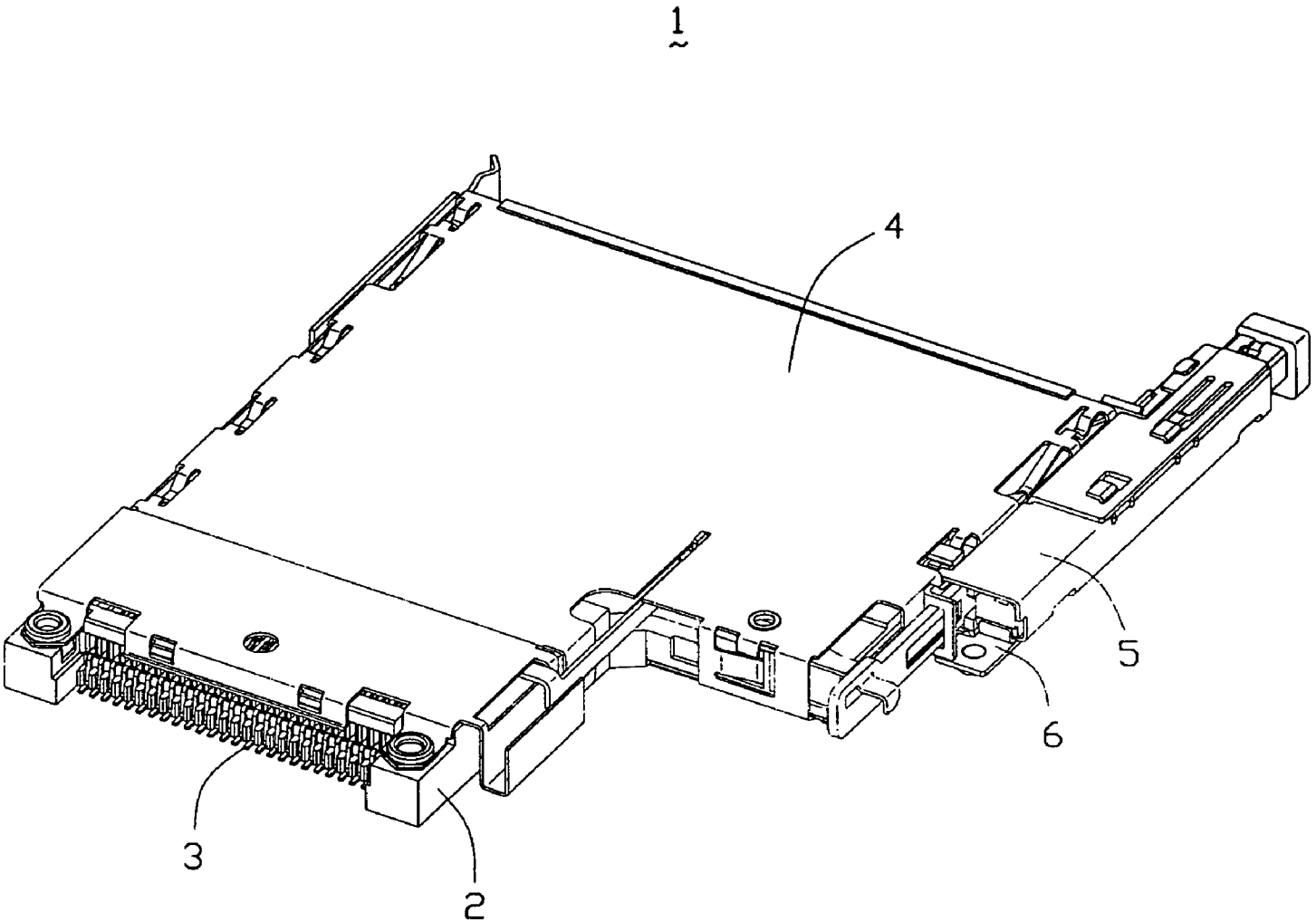
FIG. 1 is an assembled, perspective view of the card connector of a first preferred embodiment in accordance with the present invention.

Reference will now be made in detail to the preferred embodiment of the present invention.

Referring to FIGS. 1-6, a card connector 1 in accordance with the present invention is approximately L-shaped. The card connector 1 comprises and elongated insulating housing 2 with a plurality of contacts 3 being received in , a L-shaped shell 4 having two different length sidewalls, an ejector 5 disposed on the shorter sidewall of the shell 4, a pair of standoffs 6, a guide element 7 and a bottom plate 8 assembled to a bottom surface of the shell 4.

Figure 3:
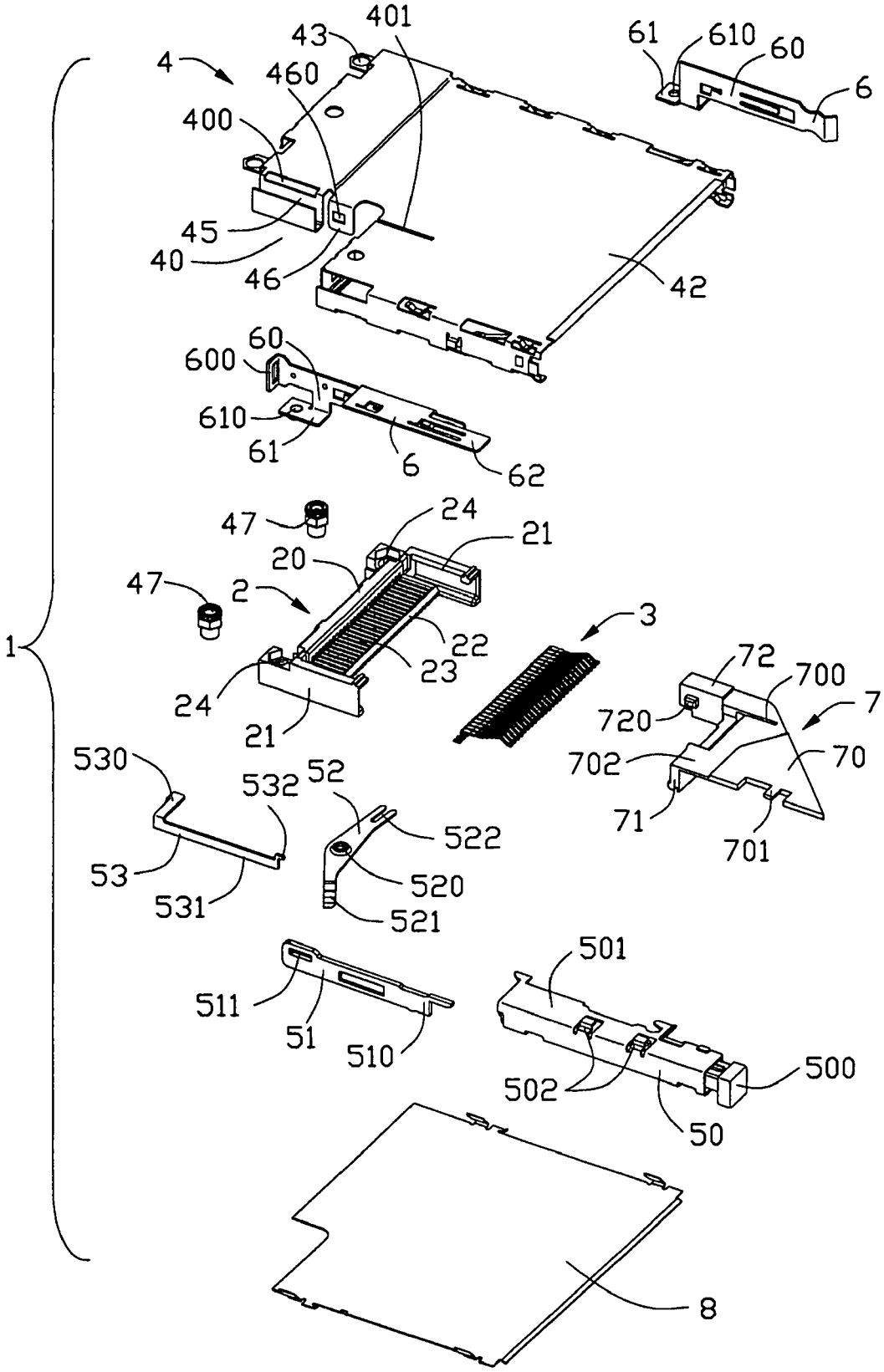
FIG. 3 is an exploded, perspective view of the card connector of FIG. 1.
Figure 4:
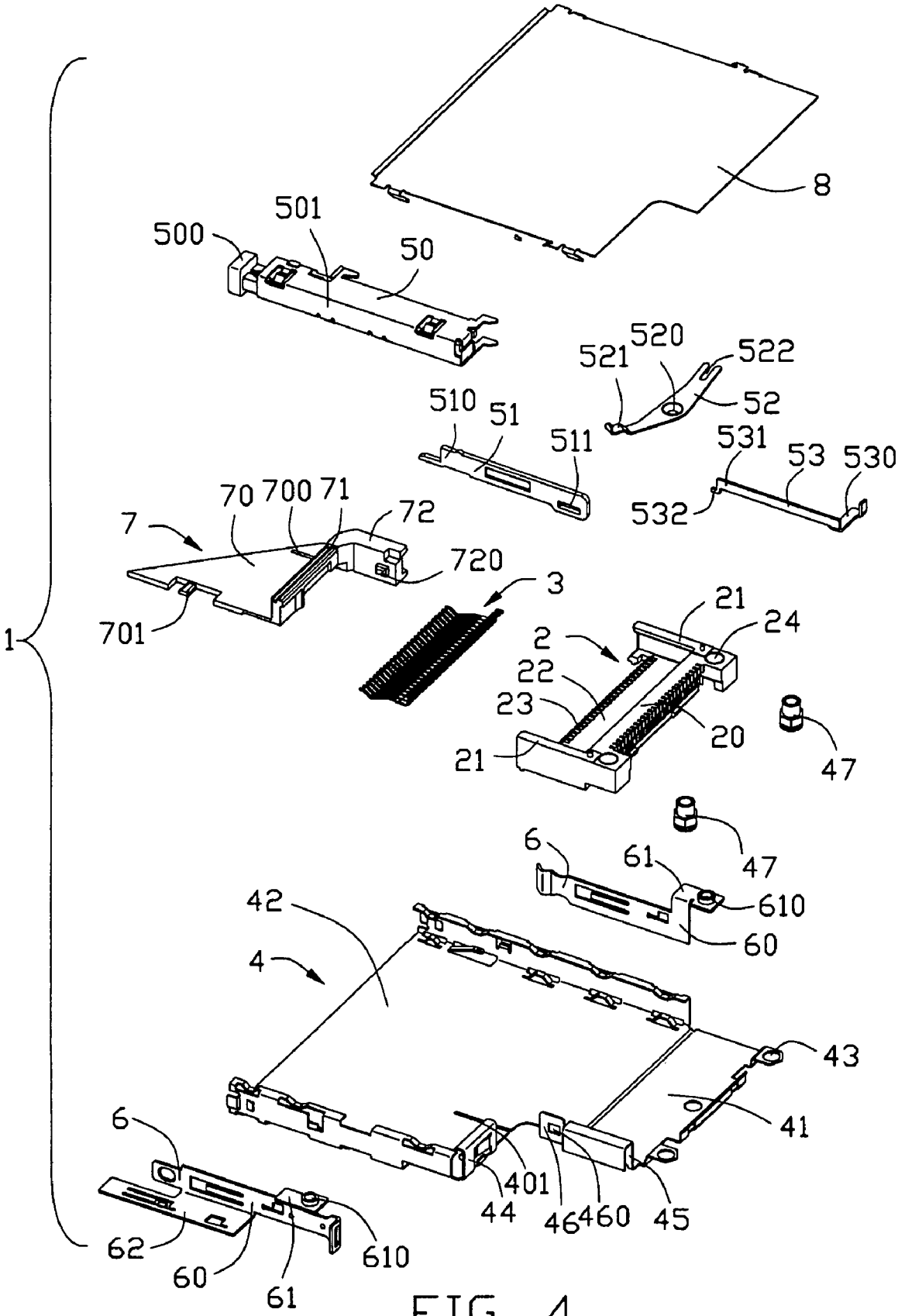
FIG. 4 is an exploded, perspective view similar to FIG. 3, but from another aspect.

Referring to FIGS. 3 and 4, the elongated insulating housing 2 has a base 20, a pair of guiding arms 21 and a pair of protrusions (not labeled) extending backwardly and forwardly from opposite sides of the base 20 respectively. A mating portion 22 extends from a lower part of the base 20 and is disposed between the two guiding arms 21. The protrusions define column holes 24 and the mating portion 22 defines a plurality of passages 23 for receiving the contacts 3.

The shell 4 covers the insulating housing 2 to define a card receiving space (not labeled) therebetween. The shell 4 is L-shaped because the shell 4 defines a step portion 40 at front end thereof. The L-shaped shell 4 comprises a front section 41 and a rear section 42 extending rearward from the front section 41. The width of the rear section 42 is wider than that of the front section along a transverse direction perpendicular to a card insertion/ejection direction. The front section 41 of the shell 4 is formed with a pair of through holes 43 at opposite sides of a front end thereof. Moreover, an U-shaped sidewall 45 and a tab 46 with a mating hole 460 extend downwardly from a lateral side of the front section 41 adjacent to the step portion 40 and locate along the card ejection direction. A transverse sidewall 44 extends downwardly from a transverse lateral side of the rear section 42 adjacent to the step portion 40 and a slot 401 is defined at the rear section 42 and is in alignment with the U-shaped sidewall 45. A pair of screws 47 are secured in the column holes 24 of the insulating housing 2 and the through holes 43 of the shell 4 to assemble the shell 4 to the insulating housing 2.

Referring to FIGS. 3 and 4, the stand offs 6 and have a right and a left stand off. Each stand off 6 has a flake 60 and a soldering piece 61 horizontally extending from a lower portion of a front end of the flake 60. A first cutout (not labeled) and a first resilient piece (not labeled) are formed on the flake 60 and a through hole 610 is formed on the soldering piece 61. Furthermore, the left stand off 6 is assembled to one sidewall of the rear section 42 adjacent to the step portion 40 and has a holding portion 600 with a holding hole (not labeled) therein formed at a front end of the flake 60 and a horizontal portion 62 extending outwardly from an upper portion the flake 60. The horizontal portion 62 defines a second cutout (not labeled) and a second resilient piece (not labeled). The stand offs 6 are assembled to the shell 4 with the aid of the first cutouts and the first resilient pieces thereof engaging with sidewalls of the rear section 42 of the shell 4.

The guide element 7 is approximately in a triangle shape and assembled to the shell 4 adjacent to the step portion 40. The guide element 7 has a board 70 and a L-shaped perpendicular wall 72 extending forwardly and downwardly from a front end of the board 70. The board 70 defines a second slot 700 communicating with the first slot 401 of the shell 4 along a vertical direction and a protruding block 701 engaging with the shell 4. A recess portion 702 is recessed downwardly from a top surface of the board 70 to define a space 703 (show in FIG. 6) between the board 70 and the shell 4 after the guide element 7 assembled. The perpendicular wall 72 has a wedge 720 received in the mating hole 460 of the tab 46 and a holding slot 71 mating with the transverse sidewall 44 to hold the guide element 7 on the shell 4.

Referring to FIGS. 1-6, the ejector 5 comprises a push member 50, a moveable member 51, a pivoting member 52 and an ejecting member 53. The push member 50 is known to one ordinary skill in the art. Thus, details of the push rod will not be illustrated. The push member 50 has a shell frame 501 and a push button 500. The shell frame 501 has a pair of locking pieces 502 to mate with the second cutout and the second resilient piece of the left stand off 6 to make the push member 50 be assembled on the left stand off 6. A rear end 510 of the moveable member 51 is received in the push member 50 moveably. One end 521 of the pivoting member 52 is received in a rectangular hole 511 of the moveable member 51 after the moveable member 51 passes through the holding hole of the holding portion 600 of the left stand off 6. The other end 522 is bifurcated to receive a rear end 532 of the ejecting member 53. The pivoting member 52 has a pivoting portion 520 in a middle portion thereof to be pivotally held in a pivoting hole (not labeled) of the rear section 42 the shell 4 adjacent to the step portion 40 so that the pivoting member 52 is pivotally exposed into the space 703. The ejecting member 53 has an ejecting portion 530 passing through an opening 400 of the shell 4 to be exposed into the card receiving space for ejecting a card and a body portion 531 connecting the ejecting portion 530 and the rear end 532. A front section of the body portion 531 is moveably received in the U-shaped sidewall 45. The rear end 532 of the ejecting member 53 moves along the first and second slots 401, 700.

Figure 5:
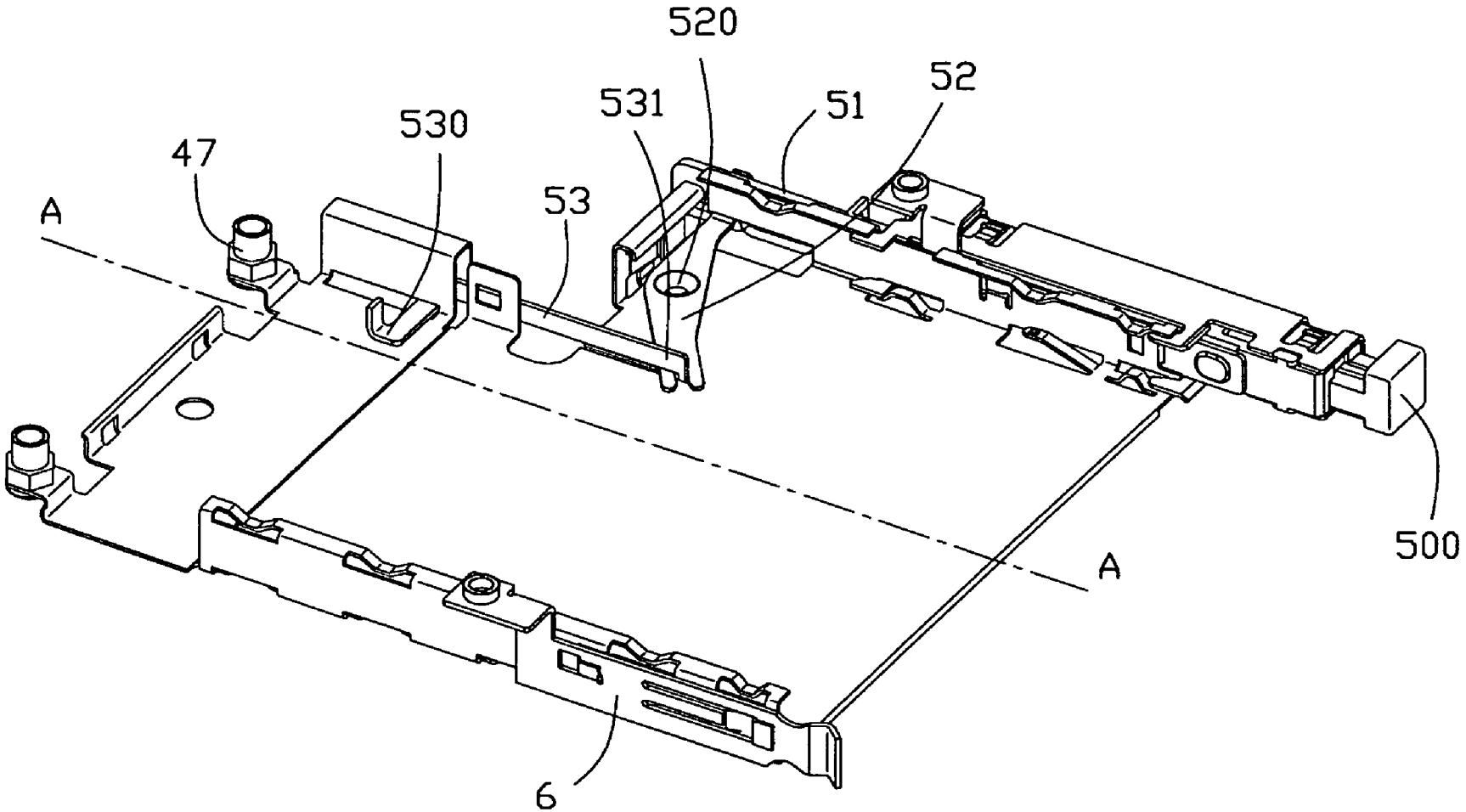
FIG. 5 is an assembled, perspective view of a shell and an ejector of the card connector of FIG. 4.
Figure 6:
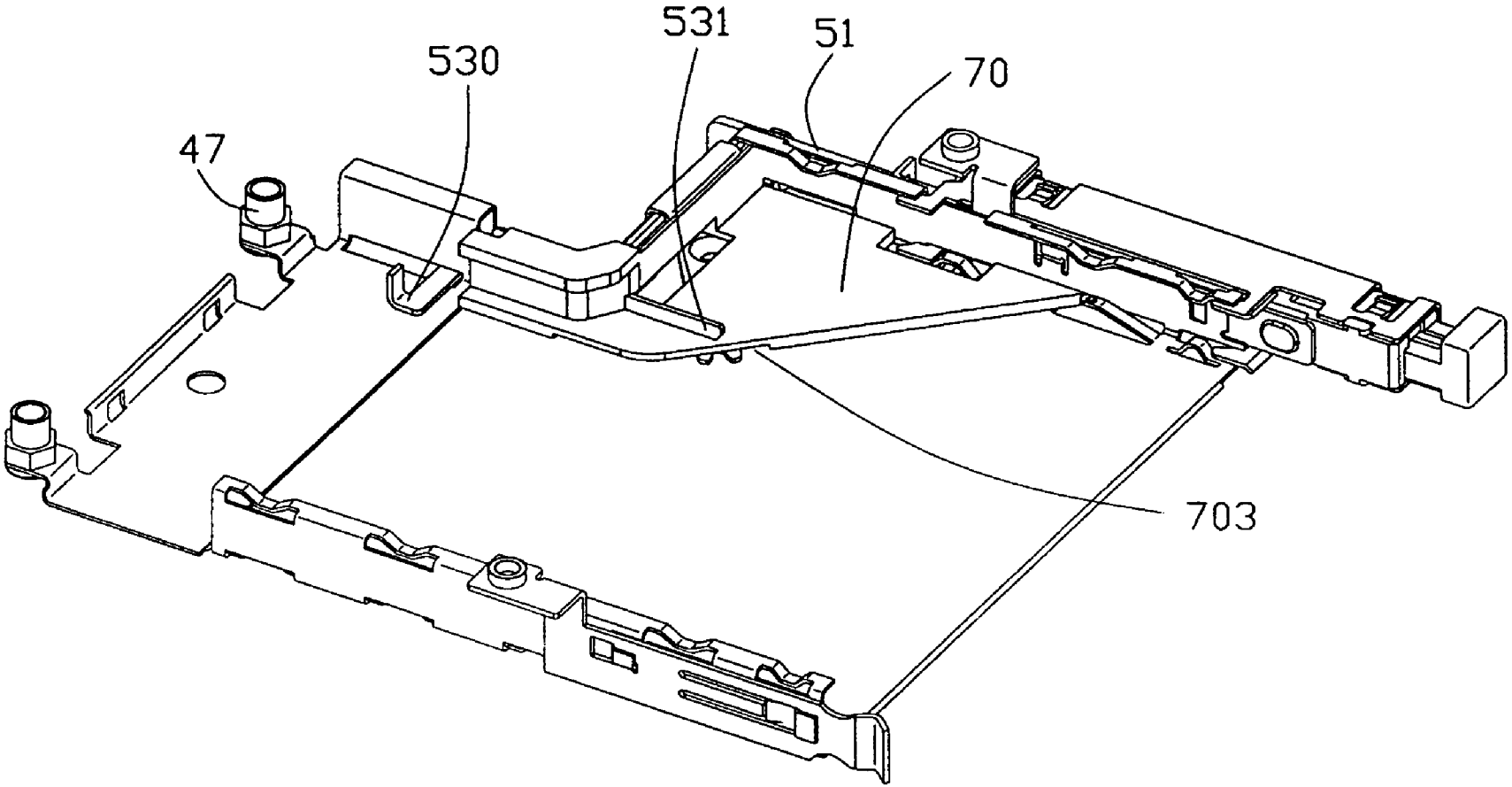
FIG. 6 is an assembled, perspective view similar to FIG. 2, but an insulating housing not assembled.

Referring to FIGS. 5-6, after the ejector 5 assembled, the ejecting member 53 moves along the U-shaped sidewall 45, the first slot 401 and the second slot 700. Thus, the ejecting portion 530 is moveable along a direction parallel to the card ejection direction to eject a card. Furthermore, the ejecting portion 530 locates adjacent to a middle line A-A of the card connector. Thus, the card will be ejected conveniently and cannot deflect. On the other hand, a rear section of the body portion 531 is exposed into the card receiving space, therefore, when ejecting a L-shaped card, the ejecting portion 530 and the rear section of the body portion 531 can urge an ejecting force on the card, respectively.

Figure 7:
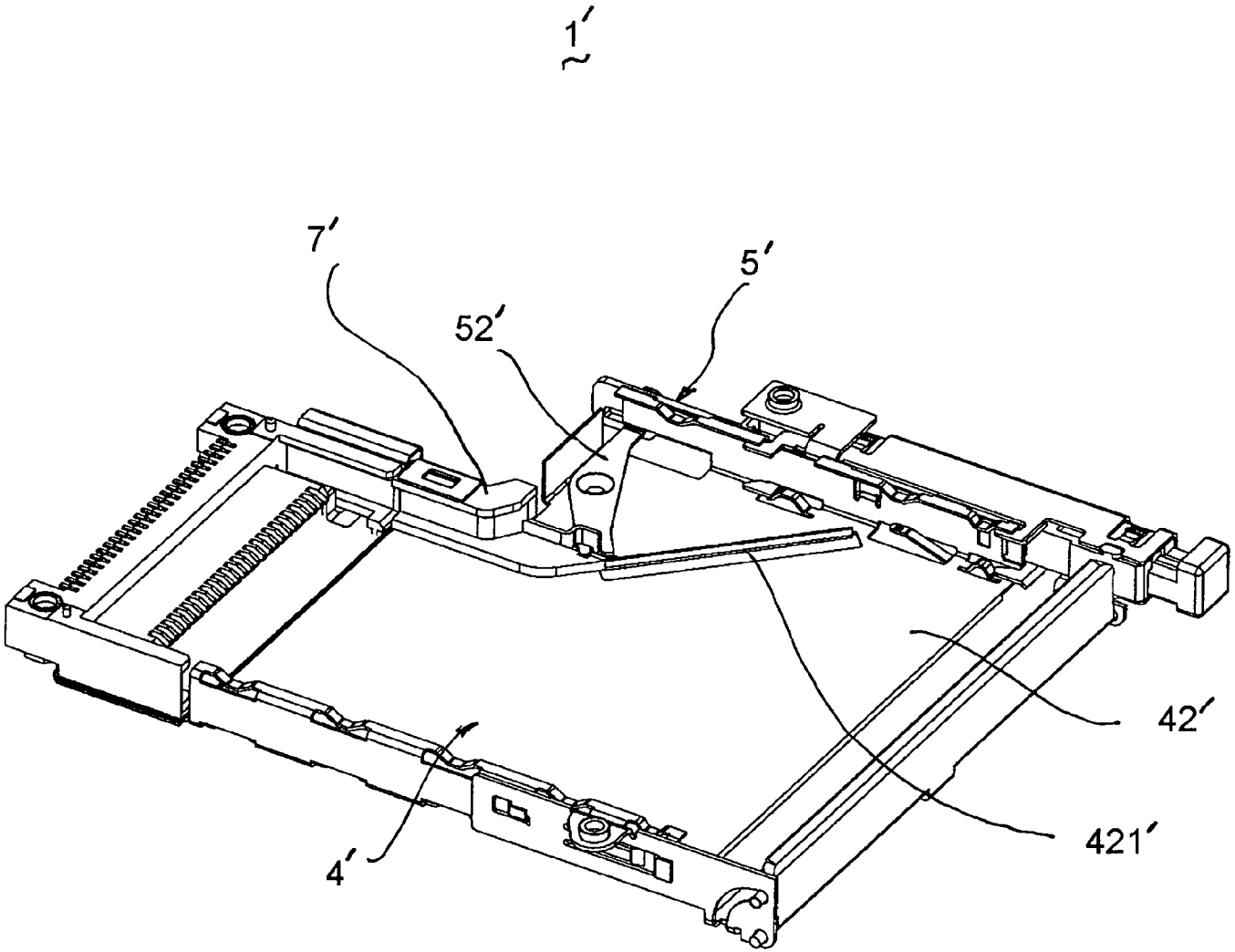
FIG. 7 is an assembled, perspective view of the card connector of a second preferred embodiment in accordance with the present invention.
Figure 8:
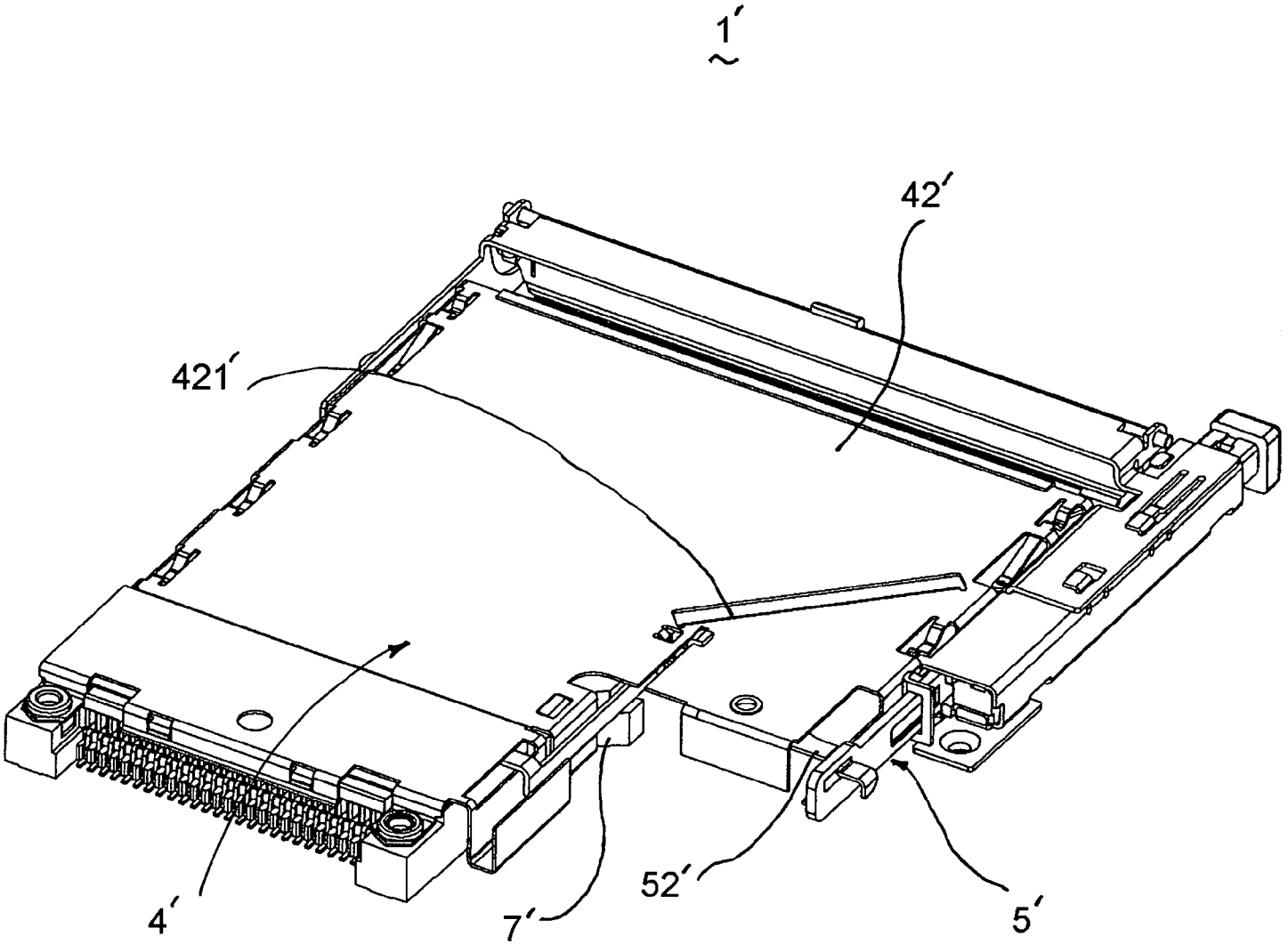
FIG. 8 is an assembled, perspective view of the card connector of FIG. 7 from another viewpoint.
Figure 9:
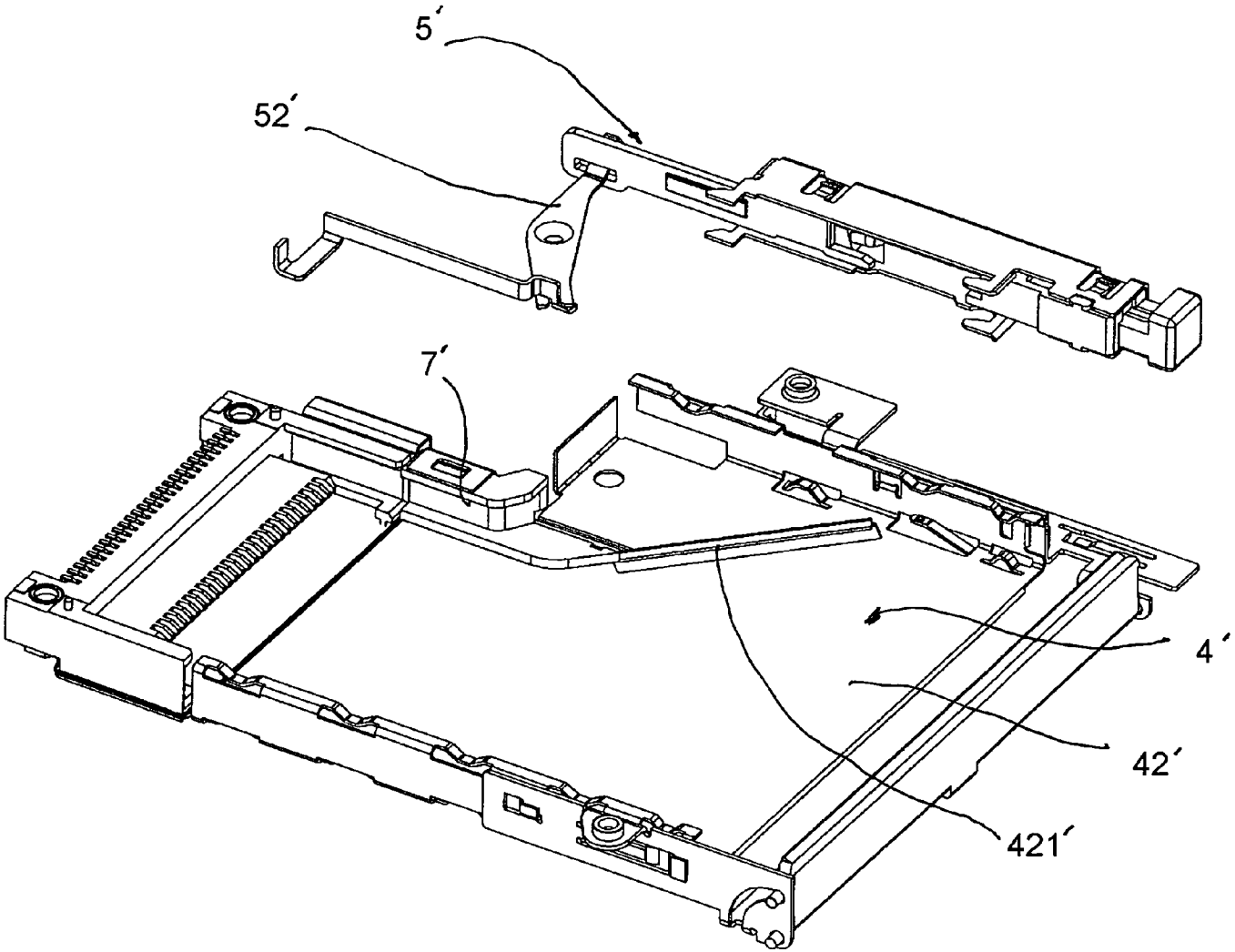
FIG. 9 is an exploded, perspective view of the card connector of FIG. 7 wherein the ejector is disassembled therefrom.

FIGS. 7-9 shows a card connector 1' of another embodiment in which the guide element 7' is simplified to essentially a straight bar extending along a front-to-back direction without the so-called corresponding board 70 and holding slot 71 mentioned in the first embedment. The oblique guiding edge of the inserted card is provided by the flange 421' formed on the rear section 42' of the shell 4' rather than the triangular board 70 of the connector 1 of the first embodiment. On the other hand, the pivoting member 52' of the ejector 5' is essentially pivotally mounted to the shell 4 without being essentially covered by or vertically overlapped with the guide element 7', thus allowing the manufacturer to directly inspect and assure the pivoting arrangement of the ejector 5' with regard to the remaining portions of the connector 1'.

Figure 2:
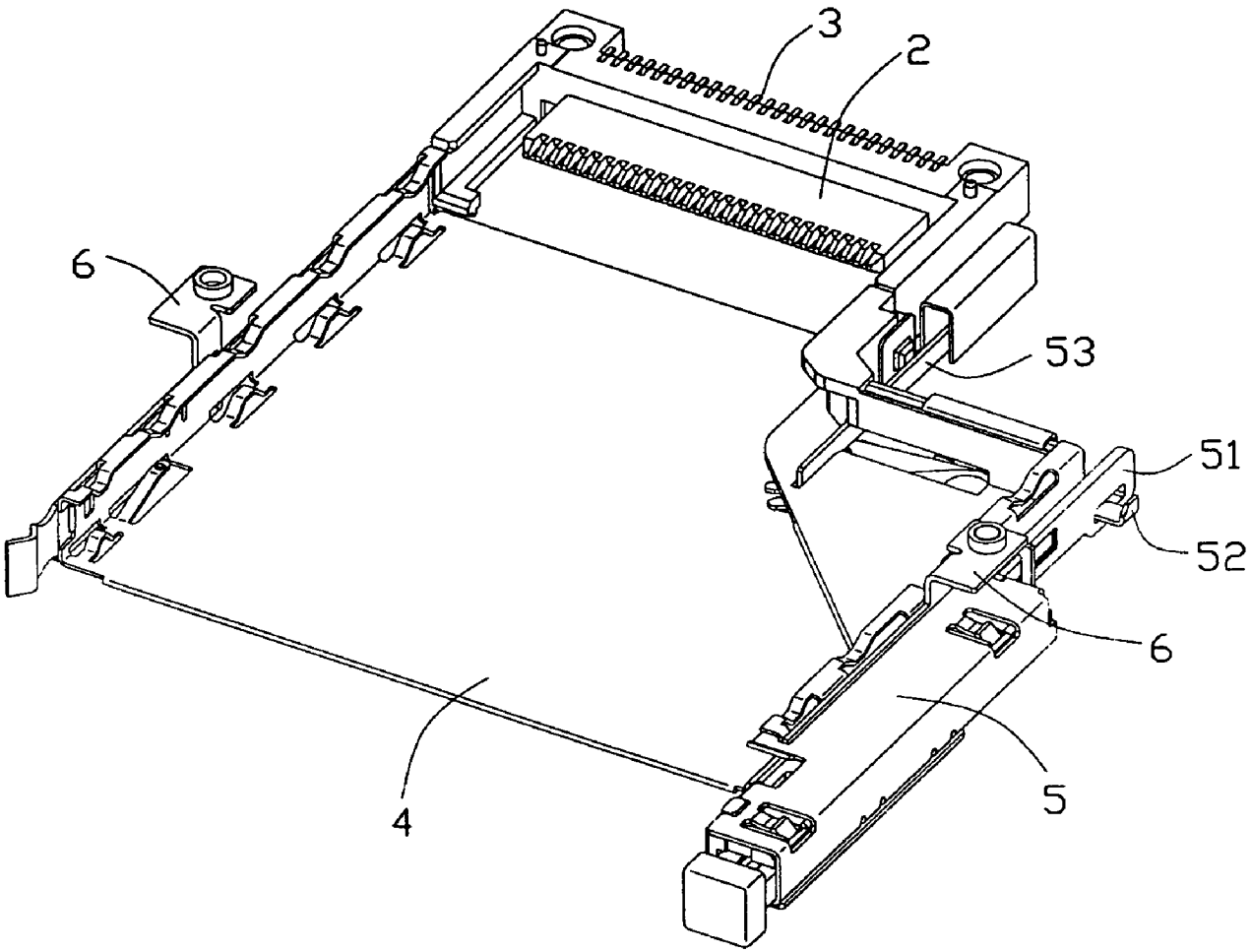
FIG. 2 is an assembled, perspective view similar to FIG. 1, but taken from another aspect and without a bottom plate.
Figure 10:
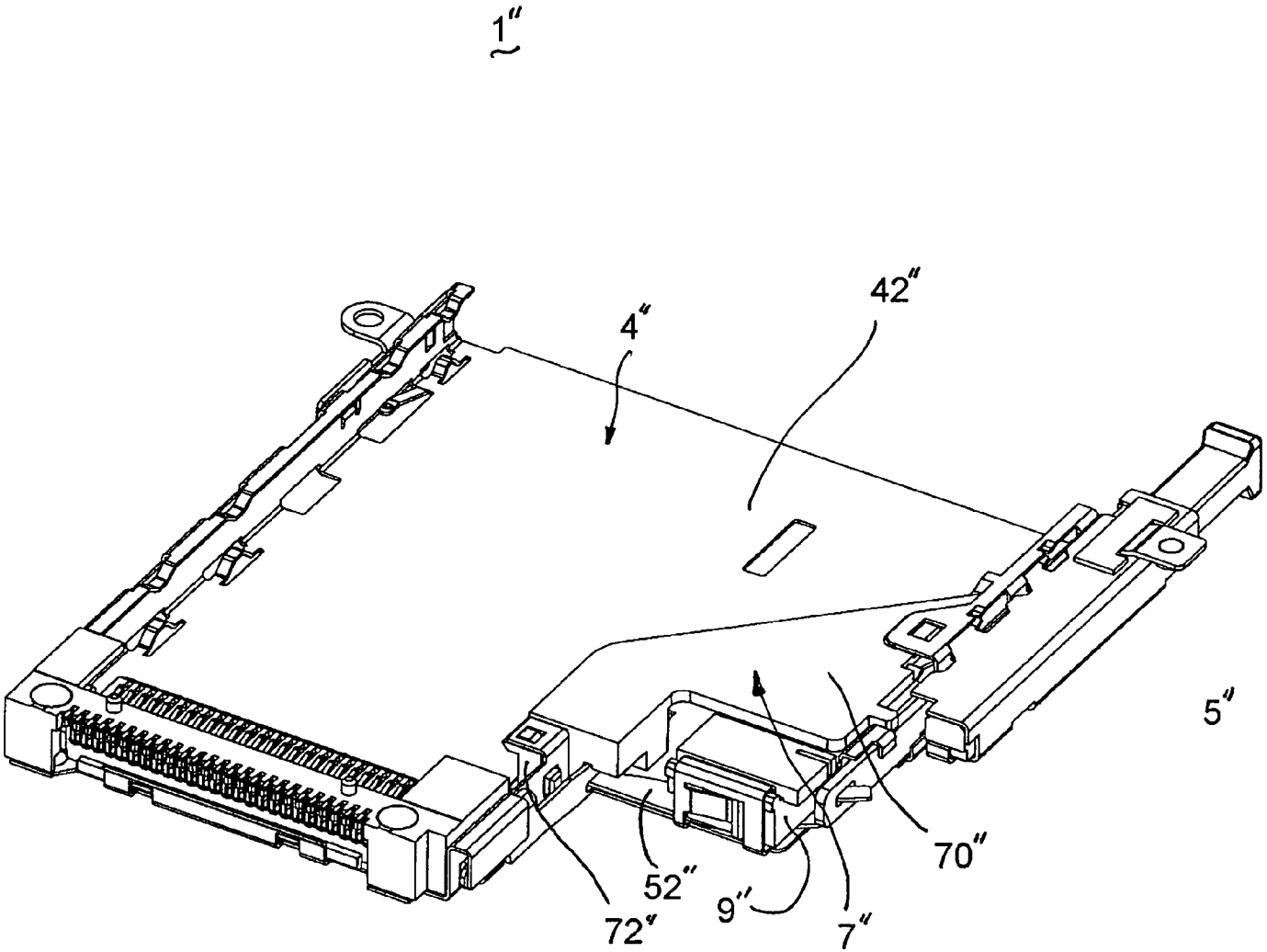
FIG. 10 is an assembled, perspective view of a card connector of a third preferred embodiment in accordance with the present invention.
Figure 11:
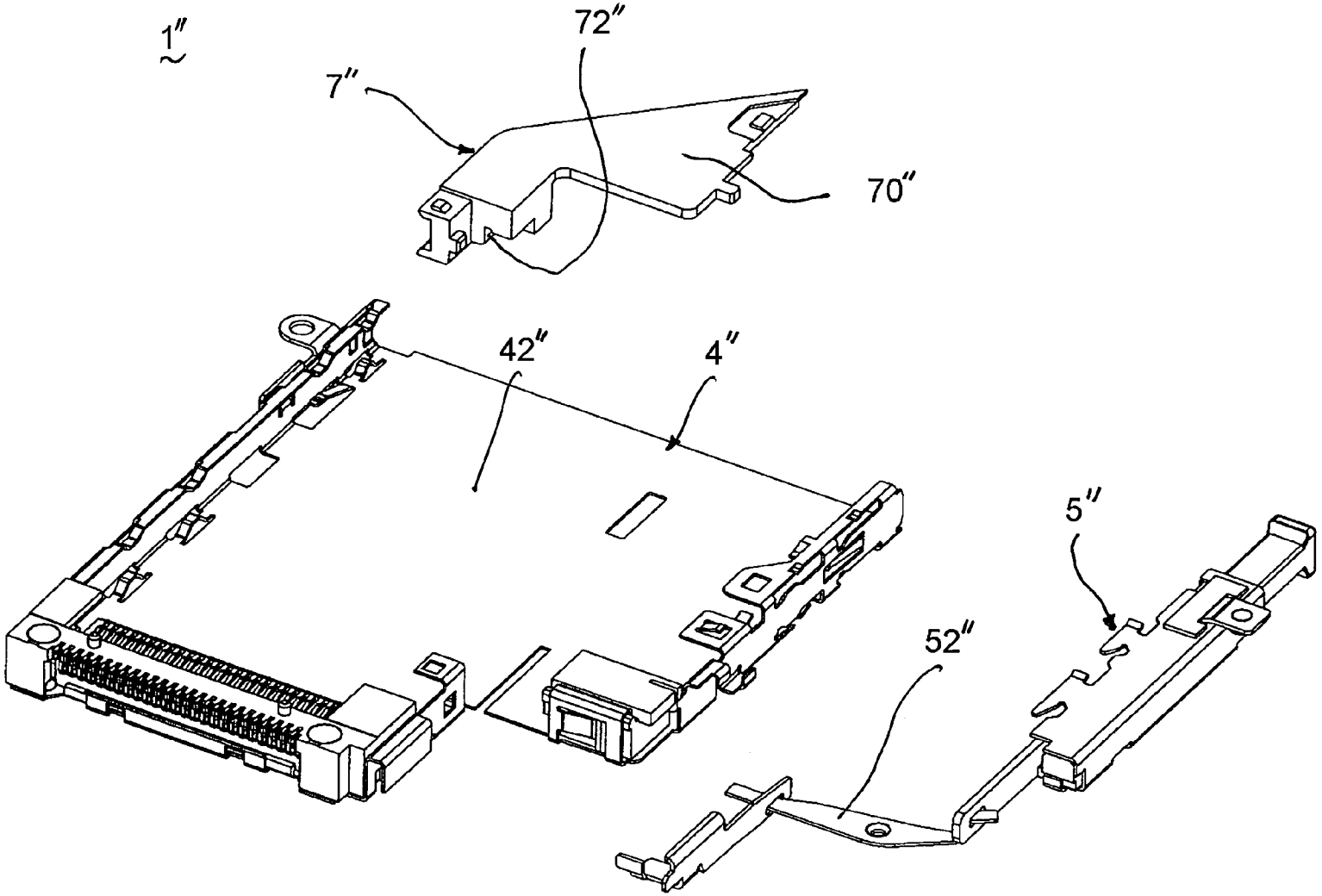
FIG. 11 is an exploded, perspective view of the card connector of FIG. 10 wherein the ejector is disassembled therefrom.
Figure 12:
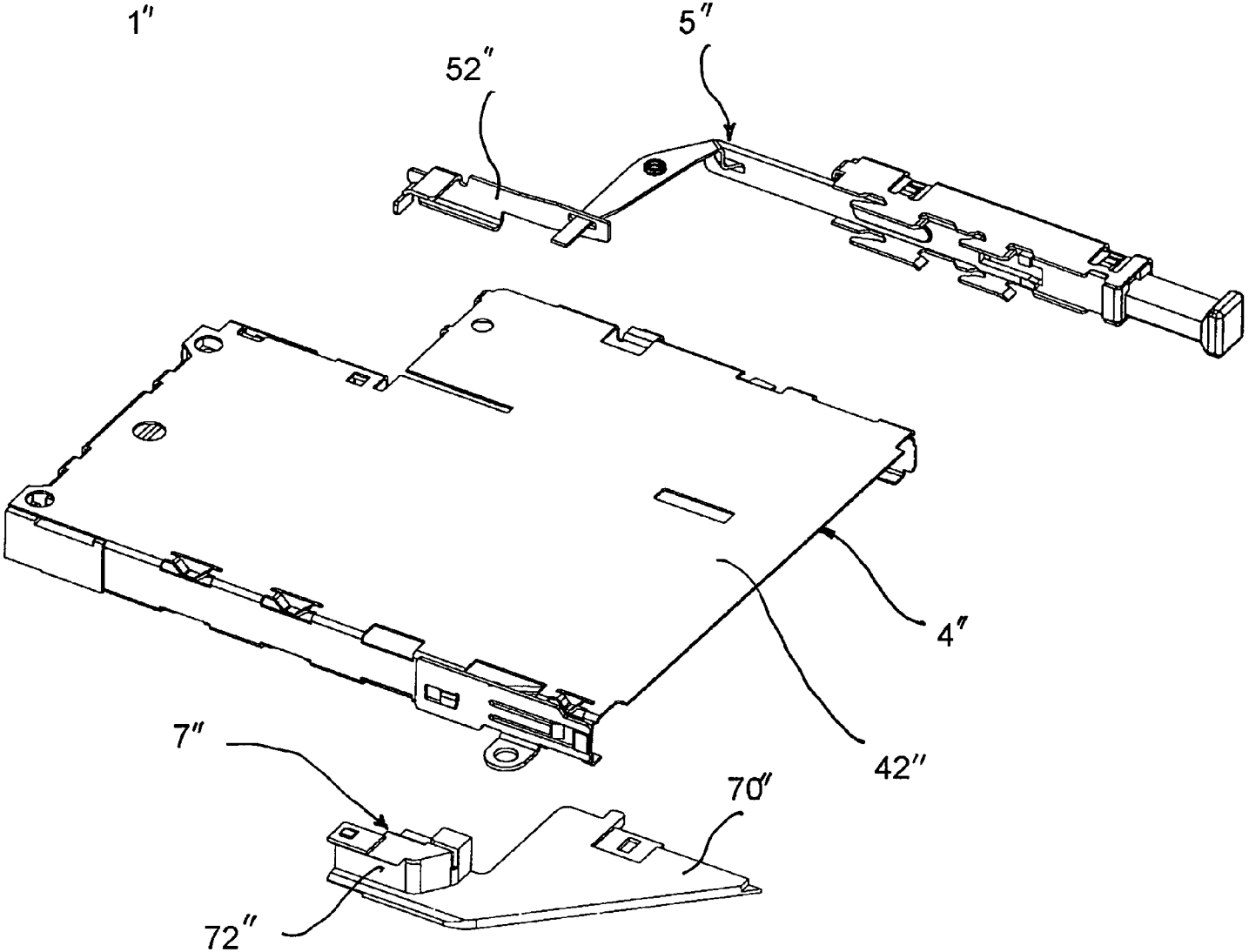
FIG. 12 is an exploded, perspective view of the card connector of FIG. 11 from another viewpoint.

FIGS. 10-12 shows another card connector of the third embodiment in which the card connector 1" is essentially a reverse type with regard to the card connector 1 and 1' by comparing FIGS. 2, 7 and 10. Similar to the first embodiment but different from the second embodiment, the guide element 7" of card connector 1" includes a straight bar 72" linked to a triangular board 70" wherein the triangular board 70" provides the oblique guiding edge thereof. Anyhow, an optional discrete block 9", which is separated from the guide element 7", is attached to the front region of a rear section 42" of the shell 4" for optionally covering a pivoting member 52" of the ejector 5" which is pivotally mounted to the front region of the rear section 42". The discrete block 9" may reinforce the structure of the shell 4" thereabouts. Understandably, the pivoting member of the instant invention is essentially directly pivotally mounted to the shell for avoiding any direct influence or impact from the guide element which guides insertion of the card.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulating housing defining a card insertion/ejection direction;

a plurality of contacts received in the insulating housing;

a shell covering the insulating housing and defining a step portion at the front end thereof;

an ejector assembled to the shell adjacent to the step portion and comprising a push member, a moveable member mating with the push member, an ejecting member to eject a card and a pivoting member mating with the moveable member and the ejecting member, the ejecting member being moveable along a direction parallel to the card ejection direction to eject the card; and a guide element having an oblique guiding edge thereof wherein said oblique guiding edge of said guide element and said pivoting member being essentially aligned with while spaced from each other in said card insertion/ejection direction.

2. The card connector as claimed in claim 1, wherein the shell is approximately of an L-shaped configuration having a first short edge region along the card insertion/ejection direction and a second short edge region along a transverse direction perpendicular to said card insertion/ejection direction, said first short edge region and said second short edge region commonly defining said step portion, and said pivoting member is assembled to said second short edge region.

3. The card connector as claimed in claim 1, wherein the pivoting member has a pivoting portion pivotally mounted on the shell.

4. The card connector as claimed in claim 3, wherein the moveable member defines a rectangular hole at a front end thereof to receive one end of the pivoting member.

5. The card connector as claimed in claim 2, further comprising a guide element disposed on the shell adjacent to the step portion to guide an insertion of the card and the guide element is approximately in a triangular shape.

6. The card connector as claimed in claim 5, wherein the guide element defines a recess portion recessed from a top surface thereof to define a space between the guide element and the shell.

7. The card connector as claimed in claim 6, wherein the ejecting member is pivotally exposed into the space.

8. The card connector as claimed in claim 5, wherein the shell defines a first slot stacked and communicating with a second slot formed on the guide element, and the first slot and the second slot define a plane in vertical direction, and the plane parallel to the card ejection direction.

9. The card connector as claimed in claim 8, wherein the ejecting member moves in the first and second slots.

10. The card connector as claimed in claim 8, wherein the shell has a U-shaped sidewall approximately in alignment with the first slot along the card insertion/ejection direction.

11. The card connector as claimed in claim 1, further comprising a standoff the standoff comprises a flake assembled to the shell and a horizontal portion extending from an upper portion of the flake.

12. The card connector as claimed in claim 11, wherein the push member comprises a locking piece to lock on the horizontal portion of the standoff.

13. A card connector comprising:

an insulating housing defining a card insertion/ejection direction;

a plurality of contacts received in the insulating housing;

a shell covering the insulating housing;

an ejector assembled to the shell and comprising a push member, a moveable member mating with the push member, an ejecting member to eject a card and a pivoting member with one end mating with the moveable member and the other end thereof bifurcated to receive a rear end of the ejecting member; and a guide element having an oblique guiding edge thereof wherein said oblique guiding edge of said guide element and said pivoting member being essentially aligned with while spaced from each other in said card insertion/ejection direction.

14. The card connector as claimed in claim 13, wherein the ejecting member is moveable along a direction parallel to the card ejection direction to eject the card.

15. The card connector as claimed in claim 13, wherein the shell is approximately of an L-shaped configuration having a first short edge region along the card insertion/ejection direction and a second short edge region along a transverse direction perpendicular to said card insertion/ejection direction, said first short edge region and said second short edge region commonly defining a step portion at a front corner portion of the shell, and said pivoting member is assembled to said second short edge region.

16. a card connector comprising:

an insulative housing having a plurality of contacts therein and defining mating port thereabouts;

a metallic shell cooperating with the housing to define an L-shaped card receiving cavity with a rear section and a front section thereof;

an ejector assembled to a shell and including a moveable pushing member located around the rear section, an ejecting member located around the front section, and a pivoting member directly pivotally mounted to the shell with two opposite ends linked to the ejecting member and the pushing member; and a guide element assembled to the front section of the shell and defining an oblique guiding edge for engagement with a card inserted into the card receiving cavity; wherein said oblique guiding edge of said guide element and said pivoting member are essentially aligned with while space from each other in said card insertion/ejection direction; wherein both said ejection member and said pushing member extend and move along the card insertion/ejection direction so that the ejection member, the pivoting member and the pushing member commonly define a Z-like configuration.

17. The card connector as claimed in claim 16, the pivoting member is disposed between the guide element and shell.

18. The card connector as claimed in claim 16, wherein the shell is approximately of an L-shaped configuration having a first short edge region along the card insertion/ejection direction and a second short edge region along a transverse direction perpendicular to said card insertion/ejection direction, said first short edge region and said second short edge region commonly defining a step portion at a front corner portion of the shell, and said pivoting member is assembled to said second short edge region.

* * * * *